US008256941B2

(12) United States Patent
Hikmet et al.

(10) Patent No.: US 8,256,941 B2
(45) Date of Patent: Sep. 4, 2012

(54) COMPACT MULTIPLE BEAM TYPE VEHICLE LIGHT SYSTEM

(75) Inventors: Rifat A. M. Hikmet, Eindhoven (NL); Ties Van Bommel, Horst (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 19 days.

(21) Appl. No.: 13/059,300

(22) PCT Filed: Aug. 17, 2009

(86) PCT No.: PCT/IB2009/053607

§ 371 (c)(1),
(2), (4) Date: Feb. 16, 2011

(87) PCT Pub. No.: WO2010/020930

PCT Pub. Date: Feb. 25, 2010

(65) Prior Publication Data

US 2011/0141754 A1 Jun. 16, 2011

(30) Foreign Application Priority Data

Aug. 22, 2008 (EP) ..... 08162797

(51) Int. Cl.
*F21V 17/02* (2006.01)

(52) U.S. Cl. ..... 362/513; 362/540; 362/543; 362/259; 362/231; 340/471; 340/479

(58) Field of Classification Search ..... 362/464, 362/507, 540, 543, 259, 513; 340/471, 479
See application file for complete search history.

(56) References Cited

U.S. PATENT DOCUMENTS

| | | | | |
|---|---|---|---|---|
| 4,670,637 | A * | 6/1987 | Morrison et al. | 219/121.6 |
| 6,123,439 | A * | 9/2000 | Hiranaka et al. | 362/459 |
| 6,883,947 | B1 * | 4/2005 | Sarabia | 362/540 |
| 7,150,552 | B2 | 12/2006 | Weidel | |
| 7,966,753 | B2 * | 6/2011 | Vanneman et al. | 37/196 |
| 2005/0004133 | A1 | 1/2005 | Makings et al. | |
| 2005/0041433 | A1 | 2/2005 | Sayers | |
| 2008/0013329 | A1 | 1/2008 | Takeda et al. | |

FOREIGN PATENT DOCUMENTS

| | | | |
|---|---|---|---|
| EP | 2063170 | A2 | 5/2009 |
| WO | 2008035267 | A2 | 3/2008 |

* cited by examiner

*Primary Examiner* — Ali Alavi
(74) *Attorney, Agent, or Firm* — Mark L. Beloborodov

(57) ABSTRACT

The invention relates to a vehicle light system comprising a laser device for generating a laser beam, further comprising a light output module provided with a phosphor element for emitting a light beam upon incidence of the generated laser beam and provided with an optical element associated with the phosphor element for producing a light output beam. Furthermore, the light system comprises a further light output module provided with a corresponding further phosphor element and a second optical element. The laser device is arranged to switch between a first state, in which the generated laser beam is directed to the phosphor element, and a second state in which the generated laser beam is directed to the further phosphor element.

11 Claims, 4 Drawing Sheets

COMPACT MULTIPLE BEAM TYPE VEHICLE LIGHT SYSTEM

FIELD OF THE INVENTION

The invention relates to a vehicle light system.

BACKGROUND OF THE INVENTION

Currently, car light systems are provided with a low-beam and a high-beam option. Furthermore, some light systems are provided with a pair of fog lights so as to cope with adverse driving conditions in fog.

American patent publication US 2005/0041433 discloses a laser device for generating a laser beam which, upon incidence on a phosphor structure, produces a light beam which is collimated to a desired optical output beam by means of an optical element.

There is a need for different beam types depending on environmental conditions. As an example, special lights would be applied during the daytime and when driving in areas with public lighting. In urban areas, with their many crossings, the actual asymmetric main beam is counter-productive, particularly because additional glare is produced during acceleration after stops. Driving on motorways at a relatively high speed, with oncoming traffic traveling on a separate carriageway, requires other lighting functions. Adverse weather conditions have another impact, due to road reflection, resulting in reduced luminosity and higher (reflected) glare. In snowy, rainy or foggy weather, the emitted light is absorbed and scattered by snowflakes or water droplets so that vision is veiled by the reflected light, thereby resulting in a shorter visual range. Therefore, legislation is being formulated in order to introduce adaptive front light systems (AFS) which adapt the shape of the beam of headlights depending on exterior lighting, such as day, dawn, public lighting, night, traffic environment, such as motorways with separate carriageways, winding country roads, town and city streets, weather conditions, such as dry, wet, rainy, snowy, foggy, and/or vehicle attitudes, such as inclination changes by load, dynamic inclination changes while driving, degree of control, speed of vehicle, and ground clearance.

Mechanical AFS systems have been suggested for producing various beam shape types. As an example, International patent publication WO 2008/035267 discloses a vehicle lamp comprising a laser device and a reflector which is provided with a movable beam limiter. However, though functionality might be satisfactory, there is a need to provide light systems without moving parts, e.g. due to cost price, compactness, reliability, durability and repairability requirements.

Furthermore, AFS systems comprising multiple LEDs have been described. Due to the presence of multiple light source elements, these multiple LED systems require much space. In addition, a complex heat sink structure is needed for cooling the light source elements. As a result, the cooling performance is poor.

OBJECT AND SUMMARY OF THE INVENTION

It is therefore an object of the present invention to provide a compact vehicle light system which is arranged to produce multiple output beam types.

According to a first aspect of the invention, a vehicle light system is provided, comprising a laser device for generating a laser beam, further comprising a light output module provided with a phosphor element for emitting a light beam upon incidence of the generated laser beam and provided with an optical element associated with the phosphor element for producing a light output beam, wherein the light system further comprises a further light output module provided with a corresponding further phosphor element and a further optical element, and wherein the laser device is arranged to switch between a first state, in which the generated laser beam is directed to the phosphor element, and a second state in which the generated laser beam is directed to the further phosphor element.

By arranging the laser device in such a way that the generated laser beam can switch from the phosphor element of the light output module to the phosphor element of the further light output module, the light system can be provided with a single laser device while different output beam types can be generated. As a result, a light source can be implemented in a compact way. Furthermore, an efficient cooling can be realized.

In one embodiment, the laser device comprises an optical switch for changing the direction and/or position of the laser beam. By providing the optical switch, the direction and/or position of the generated laser beam can be altered in a reliable, accurate manner without using moving parts, thereby obtaining a reduced cost price and an improved performance of the vehicle light system. Optical elements without moving parts such as liquid crystal elements, electrowetting elements and/or electrophoretic cells can be used for this purpose. It is noted that the direction and/or position of the beam can be changed, e.g. by providing the system with a mechanical actuator for changing the direction and/or position of the laser beam, e.g. by tilting the laser device.

In a further embodiment, the vehicle light system comprises a plurality of light output modules provided with a phosphor element for emitting a light beam upon incidence of the generated laser beam and provided with an optical element associated with the phosphor element for producing a light output beam, wherein the laser device is arranged to switch the direction and/or position of the generated laser beam towards a phosphor element of a selected light output module. As an example, a single laser device can be provided in combination with three or four light output modules, so that three or four light output beam types, respectively, can be produced. In principle, the vehicle light system can also be provided with another configuration of laser devices and corresponding light output modules, e.g. two laser devices and four light output modules. However, the light system can be advantageously realized in a very compact way by providing a single laser device.

In a specific practical embodiment, the phosphor element of an output module is arranged to emit a yellow-orange broadband light beam upon incidence of a blue light laser beam which leads to white light when incident laser light is partially converted to yellow light. When a violet laser beam or a laser beam emitting at shorter wavelengths such as UV light is used, a white emitting phosphor is used for producing white light. However, also other practical embodiments are possible, e.g. a specific embodiment, wherein the phosphor element of an output module is arranged to emit red, green and blue light upon incidence of a blue, violet or UV laser beam.

In various embodiments, the output beam shape and/or direction of the optical element provided with a first light output module differs from the output beam shape and/or direction, respectively, of the optical element provided with a second light output module. In theory, the output beam shape and/or direction may substantially coincide, e.g. for providing a spare light output module which can be used if a primary light output module does not function properly, e.g. due to mechanical damage.

A car driver can control the vehicle light system by connecting it to an automotive control system. It is noted that the vehicle light system may not only be used in a car, but also in other vehicles, such as a motor bikes, trucks, trains or ships.

According to a second aspect of the present invention, a method of controlling a vehicle light system is provided, which method comprises the steps of: switching a laser device between a first state, in which a laser beam generated by the laser device is directed to a phosphor element provided in a first light output module, and a second state, in which the generated laser beam is directed to the phosphor element provided in a second light output module, the phosphor elements being arranged to emit a light beam upon incidence of the generated laser beam, and the light output modules being further provided with an optical element for producing a light output beam.

It will be appreciated by those skilled in the art that two or more of the above-mentioned embodiments, implementations, and/or aspects of the invention may be combined in any way deemed useful.

Modifications and variations of the method, which correspond to the described modifications and variations of the vehicle light system, can be carried out by a person skilled in the art on the basis of the present description.

BRIEF DESCRIPTION OF THE DRAWINGS

In order that the invention may be more fully understood, embodiments thereof will now be described by way of example only, with reference to the drawings, in which.

The Figures are merely intended to illustrate implementations and embodiments of the invention. In these Figures, the same reference numerals refer to equal or corresponding parts.

DESCRIPTION OF EMBODIMENTS

Figure 1C:
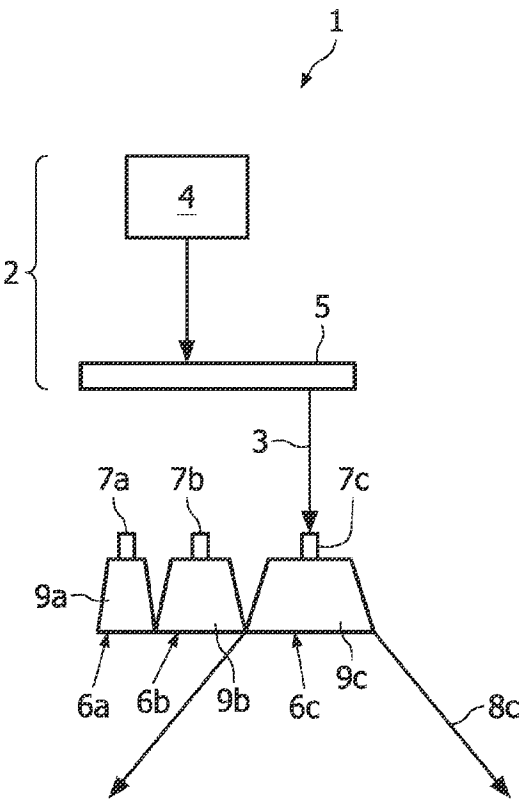
FIG. 1*c* is a schematic view of the vehicle light system of FIG. 1*a* in a third state.
Figure 1B:
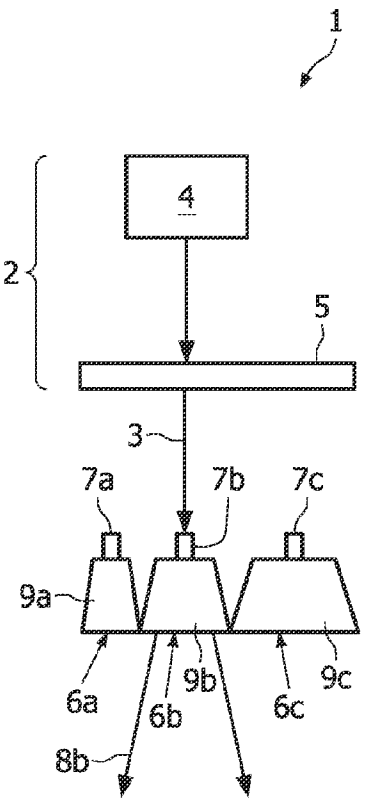
FIG. 1*b* is a schematic view of the vehicle light system of FIG. 1*a* in a second state.
Figure 1A:
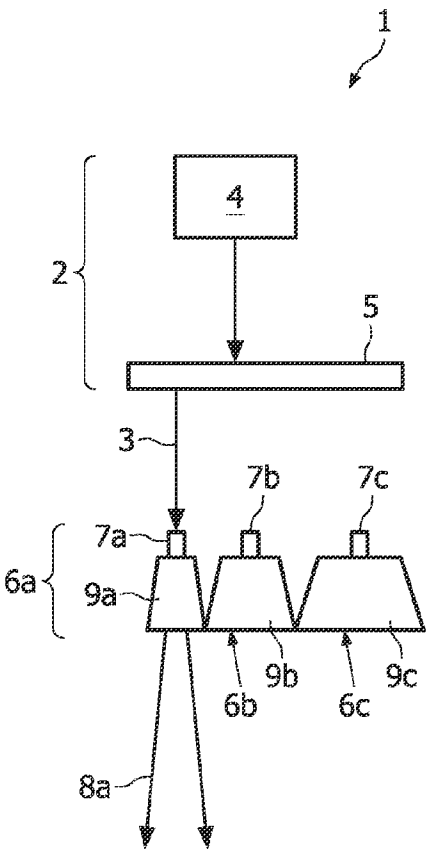
FIG. 1*a* is a schematic view of a first embodiment of a vehicle light system according to the invention in a first state.

FIG. 1*a* is a schematic view of a first embodiment of a vehicle light system 1 according to the invention. The system 1 comprises a laser device 2 for generating a laser beam 3. The laser device 2 comprises a laser source 4 and an optical switch 5 for changing the direction and/or position of the laser beam 3. The system further comprises three light output modules 6*a-c*, each provided with a phosphor element 7*a-c* for emitting a light beam 8*a-c* upon incidence of the generated laser beam. Furthermore, each light output module 6*a-c* is provided with an optical element 9*a-c* associated with the corresponding phosphor element 7*a-c* for producing a specific light output beam 8*a-c*.

In a first state, shown in FIG. 1*a*, the laser beam 3 of the laser device 2 is directed to the phosphor element 7*a* of a first light output module 6*a*. The laser light is used to pump the phosphor element which has a desired emission characteristic. The combination of the laser source 4 and the phosphor element 7*a* constitutes a light source for automotive lighting. In a second and a third state, shown in FIGS. 1*b* and 1*c*, respectively, the laser beam 3 of the laser device 2 is directed to the phosphor element 7*b*; 7*c* of a second and a third light output module 6*b*; 6*c*, respectively.

According to an aspect of the invention, the laser device 2 is arranged to switch between the above-mentioned states. The optical switch 5 controls the change of direction and/or position of the generated laser beam 3. To this end, the optical switch 5 is controlled by an automotive control system. During operation, a driver may specify a desired output beam type, such as shape and/or direction, e.g. by interacting with a user interface, so that the control system will set the associated state of the laser device 2. FIGS. 1*a-c* show, by way of example, a vehicle light system addressing three light output modules providing three different light distributions and/or directions. However, in principle, the laser device can address many more light output modules. Optionally, the light output modules are arranged in a two-dimensional array, e.g. in a 3×3 array.

Figure 2A:
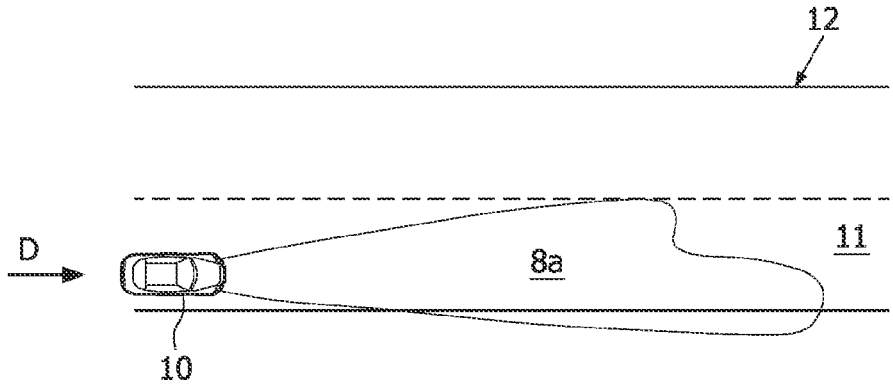
FIG. 2*a* is a schematic top view of a car provided with the vehicle light system of FIG. 1*a* in the first state.

Multiple light output modules can be used for generating various beam shapes on the road near the vehicle. FIG. 2*a* is a schematic top view of a car 10 provided with the vehicle light system 1. More specifically, two vehicle light systems 1 are assembled, viz. one system in front of the car at the left and one system in front of the car at the right. The car 10 is driving in a lane 11 on a motorway 12. The laser device 2 is in the first state, corresponding to the situation as shown in FIG. 1*a*. The optical element 9*a* of the first light output module 6*a* has been formed in such a way that an elongated beam shape 8*a* is realized substantially parallel to the driving direction D of the car 10. The elongated beam shape 13*a* has been optimized for typical motorway situations.

Figure 2B:
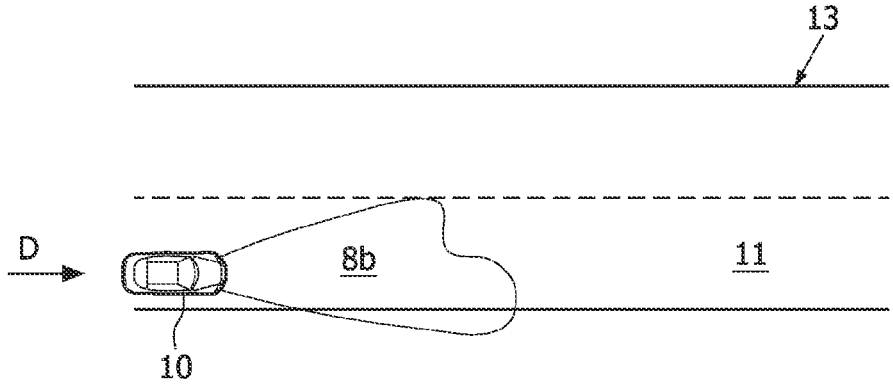
FIG. 2*b* is a schematic top view of a car provided with the vehicle light system of FIG. 1*a* in the second state.
Figure 2C:
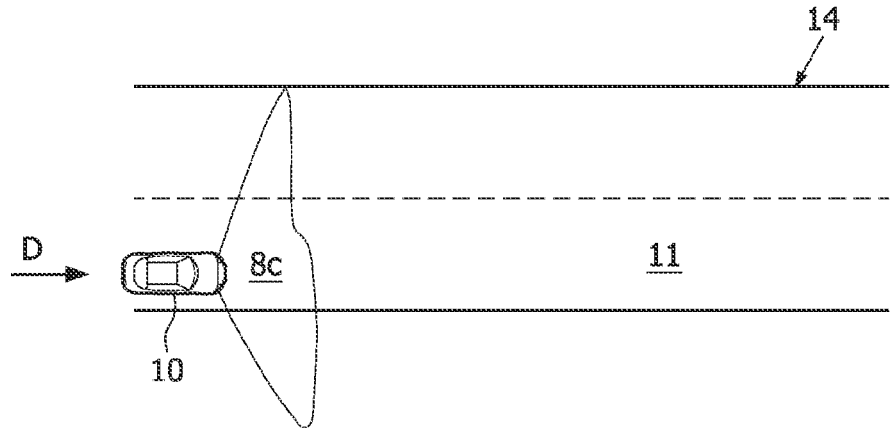
FIG. 2*c* is a schematic top view of a car provided with the vehicle light system of FIG. 1*a* in the third state.

FIG. 2*b* is a schematic top view of the same car 10, but on a lane 11 in a cross-country environment 13. The laser device 2 has been switched to the second state, corresponding to the situation as shown in FIG. 1*b*. Here, the optical element 9*b* of the second output module 6*b* has such a geometry that a broader beam shape 8*b* is produced, optimized for cross-country situations. Similarly, FIG. 2*c* shows the car in a city 14, in which the laser device 2 has been switched to the third state, corresponding to the situation as shown in FIG. 1*c*. Here, the beam shape 8*c* is even broader and illuminates a broader field of interest for the driver. In the above example, the front of the car 10 is provided with two vehicle light systems according to the invention. Alternatively, more than two vehicle light systems, e.g. three, four or more vehicle light systems according to the invention can be assembled to the vehicle, e.g. in order to obtain an enhanced light intensity and/or a more complicated beam shape on the road.

Figure 3C:
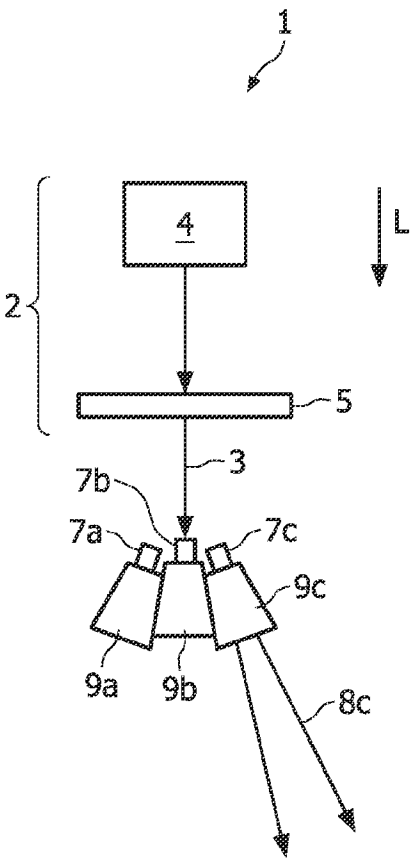
FIG. 3*c* is a schematic view of the vehicle light system of FIG. 3*a* in a third state.
Figure 3B:
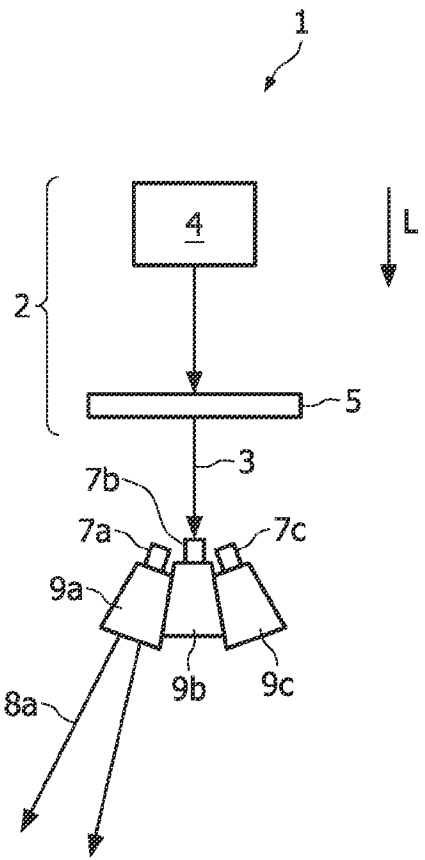
FIG. 3*b* is a schematic view of the vehicle light system of FIG. 3*a* in a second state.
Figure 3A:
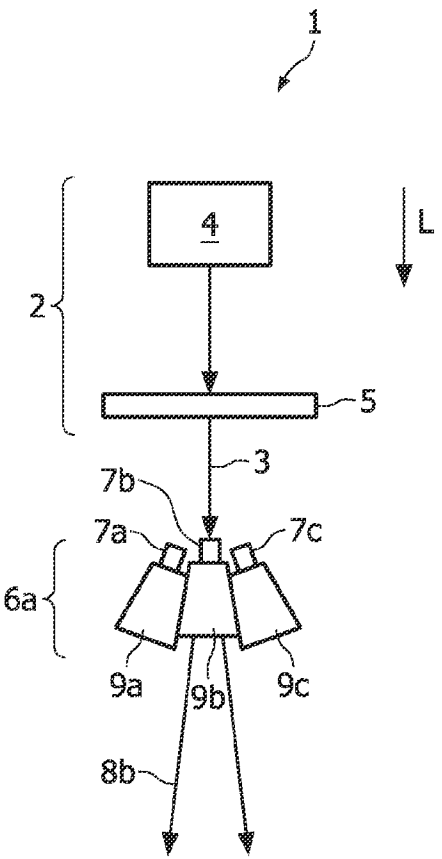
FIG. 3*a* is a schematic view of a second embodiment of a vehicle light system according to the invention in a first state.

Alternatively or additionally, the direction of the produced light output beam can be changed, as the optical element of the corresponding light output module can be formed to produce the output beam in a desired direction. FIGS. 3*a*, 3*b* and 3*c* are schematic views of a second embodiment of a vehicle light system 1 according to the invention in a first, a second and a third state, respectively. In the first state, the light output beam is directed in line with the generated laser light beam. In the second state, the light output beam is directed to the right, when viewed in the direction of propagation L, while in the third state, the light output beam is directed to the left, also when viewed in the direction of propagation L. As a result, the output light can be advantageously directed into a driving direction when the vehicle is making a turn. Again, multiple laser devices and/or multiple light output modules can be used. The light output modules can e.g. be arranged in a one-dimensional or two-dimensional array.

Figure 4:
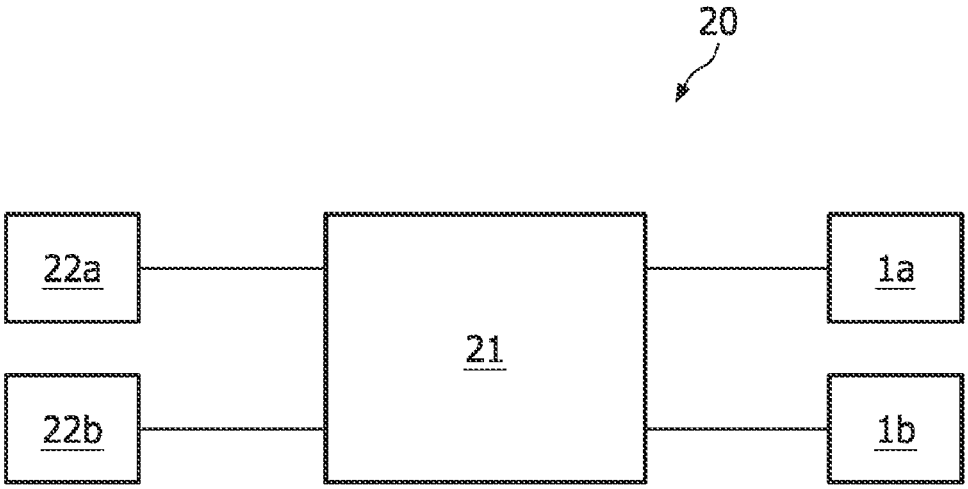
FIG. 4 shows diagrammatically an illumination system for a vehicle.

FIG. 4 shows diagrammatically an illumination system 20 for a vehicle. The illumination system 20 comprises a control system 21 connected to a plurality of vehicle light systems 1*a*, 1*b* as described above, viz. two vehicle light systems 1*a*, 1*b* in the embodiment shown. These systems are arranged on a front side of a vehicle 10 but are not limited to this side. Furthermore, the illumination system 20 comprises one or a plurality of sensors 22*a*, 22*b*. The sensors 22 are arranged to measure one or more conditions, such as weather parameters, lighting conditions, vehicle orientation parameters, global position parameters (e.g. using GPS), driving conditions such as speed, steering wheel angles, traffic environment, such as oncoming vehicles, etc. The control system 21 is arranged to apply control signals to the vehicle light systems 1*a*, 1*b* for controlling the light output of the vehicle light systems 1*a*, 1*b*, e.g. by switching the light systems on/off and/or by controlling the optical switch 5 to modify a beam shape 8, depending on one or more parameters measured by the sensors 22. As a result, an adaptive light system is obtained. Obviously, the illumination system 20 may also comprise a different number of vehicle light systems 1*a*, 1*b*, e.g. one or more than two, e.g. four vehicle light systems.

The invention is not limited to the embodiments described herein. It will be understood that many variants are possible.

Instead of or in addition to assembling the vehicle light system in front of a vehicle, the light system can also be assembled to the rear of a vehicle.

Whilst specific embodiments of the invention have been described hereinbefore, it will be appreciated that the invention may be practiced in ways other than those described. The description is not intended to limit the invention. Any reference signs in the claims shall not be construed as limiting the scope.

The invention claimed is:

1. A vehicle light system, comprising a laser device for generating a laser beam, a light output module provided with a phosphor element for emitting a light beam upon incidence of the generated laser beam and provided with an optical element associated with the phosphor element for producing a light output beam, a further light output module provided with a corresponding further phosphor element and a further optical element, wherein the laser device is arranged to switch between a first state, in which the generated laser beam is directed to the phosphor element, and a second state in which the generated laser beam is directed to the further phosphor element.

2. A vehicle light system according to claim 1, wherein the laser device comprises an optical switch for changing the direction and/or position of the laser beam.

3. A vehicle light system according to claim 1, comprising a plurality of light output modules provided with a phosphor element for emitting a light beam upon incidence of the generated laser beam and provided with an optical element associated with the phosphor element for producing a light output beam, wherein the laser device is arranged to switch the direction and/or position of the generated laser beam towards a phosphor element of a selected light output module.

4. A vehicle light system according to claim 1, comprising a single laser device.

5. A vehicle light system according to claim 1, wherein the phosphor element of an output module is arranged to emit a yellow-orange broadband light beam upon incidence of a blue light laser beam leading to white light.

6. A vehicle light system according to claim 1, wherein the phosphor element of an output module is arranged to emit red, green and blue light upon incidence of a blue, violet or UV laser beam.

7. A vehicle light system according to claim 1, wherein the output beam shape of the optical element provided with a first light output module differs from the output beam shape of the optical element provided with a second light output module.

8. A vehicle light system according to claim 1, wherein the output beam direction of the optical element provided with a first light output module differs from the output beam direction of the optical element provided with a second light output module.

9. A vehicle light system according to claim 1, further comprising an automotive control system.

10. An illumination system for a vehicle, comprising a control system, a vehicle light system and a sensor connected to the control system, wherein the control system is arranged to generate a vehicle light system control signal in dependence upon a parameter measured by the sensor.

11. A method of controlling a vehicle light system, the method comprising the steps of: switching a laser device between a first state, in which a laser beam generated by the laser device is directed to a phosphor element provided in a first light output module, and a second state, in which the generated laser beam is directed to the phosphor element provided in a second light output module, the phosphor elements being arranged to emit a light beam upon incidence of the generated laser beam, and the light output modules being further provided with an optical element for producing a light output beam.

* * * * *